US006109669A

United States Patent [19]

Pinkow

[11] Patent Number: 6,109,669

[45] Date of Patent: Aug. 29, 2000

[54] LOAD FLOOR SLAM-ACTION PAW LATCH

[75] Inventor: Christopher J. Pinkow, Boothwyn, Pa.

[73] Assignee: Southco, Inc., Concordville, Pa.

[21] Appl. No.: 09/163,254

[22] Filed: Sep. 30, 1998

[51] Int. Cl.[7] ..... E05C 1/10

[52] U.S. Cl. ..... 292/175; 292/DIG. 31

[58] Field of Search ..... 292/175, 165, 292/163, 169, 140, 143, 145, 146, 173, DIG. 38, DIG. 31

[56] References Cited

U.S. PATENT DOCUMENTS

| | | | |
|---|---|---|---|
| 1,877,612 | 9/1932 | Stieglitz | 292/173 X |
| 2,608,085 | 8/1952 | Castle | 292/173 X |
| 2,642,300 | 6/1953 | Pelan | 292/173 |
| 2,649,322 | 8/1953 | Mack | 292/173 |
| 2,721,751 | 10/1955 | Holritz | 292/169 |
| 2,840,407 | 6/1958 | Sellon, Jr. | 292/169 |
| 2,916,905 | 12/1959 | Podlesak | 292/173 X |
| 2,987,908 | 6/1961 | Pelcin | 292/173 X |
| 3,081,617 | 3/1963 | McKay | 292/173 X |
| 3,449,005 | 6/1969 | Pastva, Jr. | 292/173 |
| 3,494,650 | 2/1970 | Slopa | 292/173 X |
| 3,495,862 | 2/1970 | McClintock | 292/173 |
| 3,707,862 | 1/1973 | Pastva, Jr. | 292/173 X |
| 3,743,336 | 7/1973 | Andrews | 292/173 |
| 3,782,141 | 1/1974 | Doerrfeld | 70/146 |
| 3,871,198 | 3/1975 | Miller | 292/173 X |
| 4,116,027 | 9/1978 | Tannery | 70/472 |
| 4,138,869 | 2/1979 | Pelcin | 70/151 R |
| 5,292,159 | 3/1994 | Sandhu et al. | 292/173 |
| 5,484,178 | 1/1996 | Sandhu et al. | 292/173 |

*Primary Examiner*—B. Dayoan
*Assistant Examiner*—Gary Estremsk
*Attorney, Agent, or Firm*—Paul & Paul

[57] ABSTRACT

A closure panel latch having a housing, a handle pivotally connected to the housing, a pawl member which slides along tracks provided in the housing and a spring which biases a pawl into engagement with a keeper member, the handle including a tab portion which engages with said pawl to retract the pawl against the bias of the spring member to release the latch when the handle is lifted, the latch being closed by slam-action, and having mounting elements on the housing for mounting the latch to a closure panel.

10 Claims, 6 Drawing Sheets

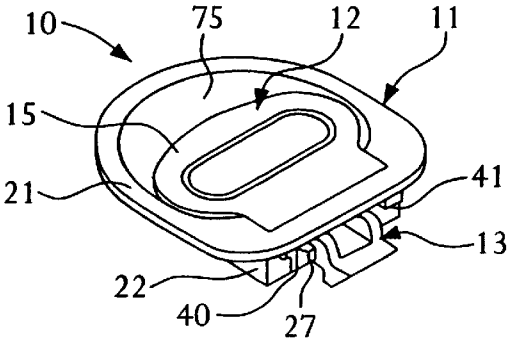
FIG. 1
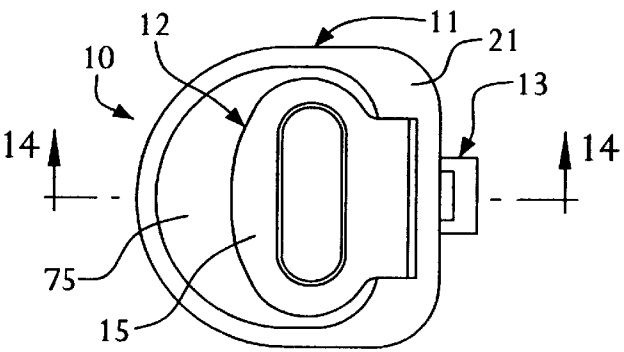
FIG. 2
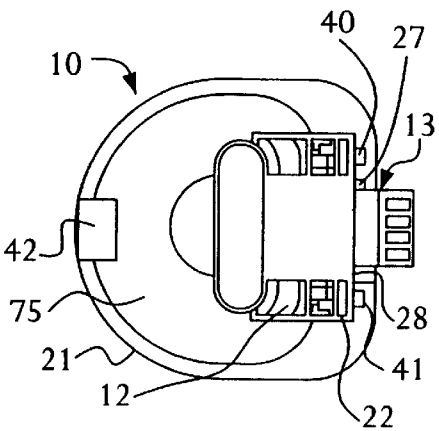
FIG. 6
FIG. 4
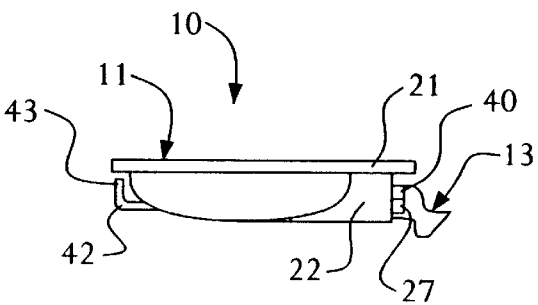
FIG. 5
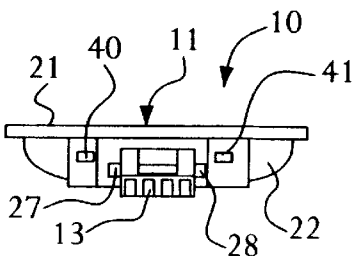
FIG. 3

LOAD FLOOR SLAM-ACTION PAW LATCH

BACKGROUND OF THE INVENTION

1. Field of the Invention

The present invention relates to the field of latches and more particularly to slam-action latches in which a handle is lifted to release the latch from engagement.

2. Brief Description of the Prior Art

Slam-action latches are known in the art and are employed in a number of applications. Generally, latches coming within this category operate by forcing a pawl into engagement with a keeper. For example, where a first panel member has a pawl and a second panel member, such as, for example, a cabinet, has a keeper thereon, slamming shut the first panel member against the second panel member secures the panels.

In many cases, floor compartments of vehicles need to be secured so that when the vehicle is operating, the floor panel will not become detached. A loose or detached panel can cause the compartment contents to escape and further can damage the panel and floor if repeated slamming of the door panel and frame occurs. A floor panel generally covers areas or compartments which must be readily accessed for maintenance and storage purposes. A latch is needed which will secure a floor panel upon closing the panel and which can be readily actuated to release the floor panel to thereby provide access to the area below the panel.

SUMMARY OF THE INVENTION

The present invention provides a latch having a housing which holds a handle, a pawl member and a spring which biases a pawl into engagement with a keeper member. The latch handle retracts the pawl from engagement with a keeper member by engaging the pawl. As the handle is lifted it pivots relative to the housing to engage the pawl and draw the pawl away from the keeper member. The pawl is retracted against the bias of the spring member. When the handle is released, the spring member then returns the pawl to its engaging position.

The latch can be closed by slamming the panel to which it is mounted shut. Alternately, the handle can be lifted to move the pawl out of the way of the keeper while the panel is closed, and then the handle can be released to allow the pawl to extend so as to be engaged by the keeper member.

The housing preferably provides a gripping area or recess for facilitating grasping of the handle by a user. The housing can further provide a barrier to the compartment covered by the floor panel so that no objects inadvertently fall into the compartment through the latch.

It is a primary object of the present invention to provide a latch which is useful for securing a first panel or member to a second panel or member.

It is another object of the present invention to provide a latch which can be used in an installation where the latch is mounted on a closure panel to regulate entry into an enclosure covered by the closure panel and provide a barrier to prevent a user's hand or fingers, or objects, from inadvertently entering the compartment.

Another object of the present invention is to provide a novel latch which can secure one or more panels or members together, for release upon actuating a handle of the latch.

Another object of the present invention is to accomplish the above objects by providing a spring-biased latch which can be closed by slam-action.

Another object of the present invention is to provide a latch which can be used in connection with panels of automobiles, such as, for example, a floor panel, to regulate access to and from an area or compartment.

Another object of the present invention is to provide a novel latch which can be constructed from few components.

Another object of the present invention is to provide a latch which can be mounted to a closure panel by snap-fitting a housing into a panel cut-out.

BRIEF DESCRIPTION OF THE DRAWING FIGURES

FIG. 1 is a left side, parallel perspective view of the latch of FIG. 1, viewed from the top.

FIG. 2 is a top plan view of the latch shown in FIG. 1.

FIG. 3 is a front elevation view of the latch according to the present invention.

FIG. 4 is a rear front elevation view of the latch according to the present invention.

FIG. 5 is a left side elevation view of the latch according to the present invention.

FIG. 6 is a bottom plan view of the latch according to the present invention.

DETAILED DESCRIPTION OF THE PREFERRED EMBODIMENTS

Figure 8:
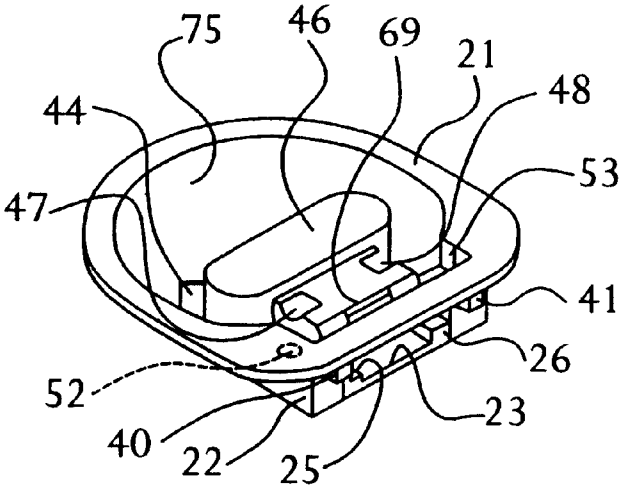
FIG. 8 is a left side, parallel perspective view of the latch housing shown in FIG. 7, viewed from the top.

Reference being made to FIG. 1, where a load floor latch 10 according to the present invention is shown comprising a housing 11, a handle 12, and a pawl 13. A biasing member, such as, for example, the spring 14 (FIGS. 14 and 15), is provided to bias the pawl 13 into a forward position so that it can engage a keeper member (not shown).

Figure 11:
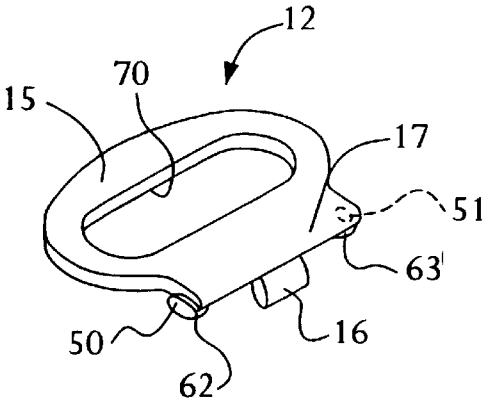
FIG. 11 is a left side, parallel perspective view of the handle of the latch shown in FIGS. 1–6.
Figure 13:
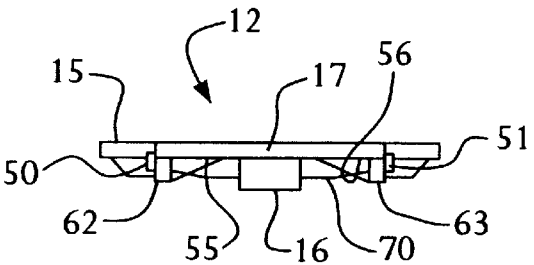
FIG. 13 is a front elevation view of the handle of the latch shown in FIGS. 1–6.
Figure 12:
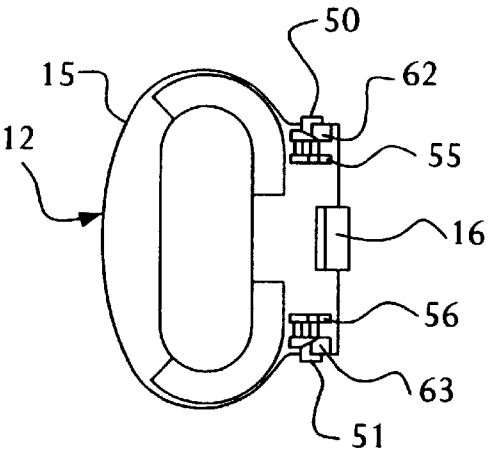
FIG. 12 is a bottom plan view of the handle of the latch shown in FIGS. 1–6.

The handle 12 includes a gripping portion 15, configured as a ring, and includes engaging means for engaging the pawl member 13. Preferably, as shown in FIGS. 11–13, the engaging means is provided as a tab 16 extending downwardly from the handle body 17.

Figure 15:
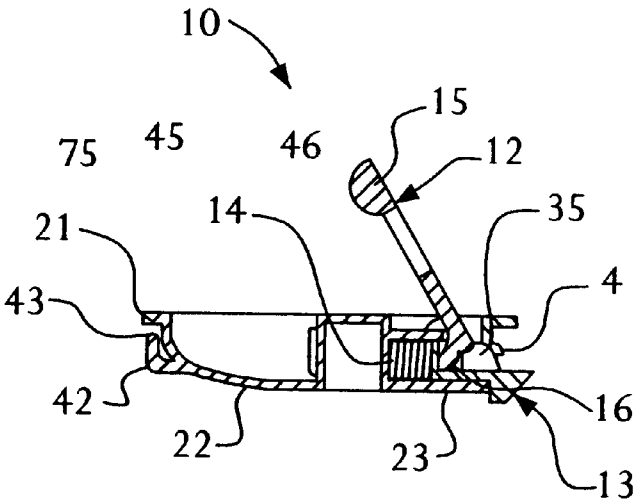
FIG. 15 is a sectional view of the latch of FIG. 14, but shown with the handle raised and the pawl retracted.
Figure 14:
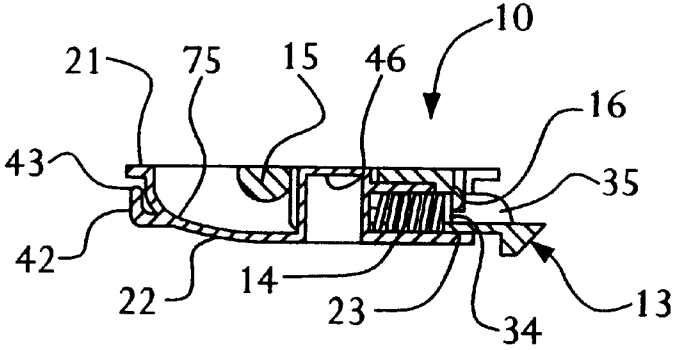
FIG. 14 is a sectional view taken along the line 14—14 of FIG. 2.

As shown in FIGS. 1 and 2, the housing 11 is provided with a mounting flange 21 which is attached to the housing body 22. The housing body 22 retains the pawl 13, the handle 12 and the spring 14 (FIGS. 14 and 15). There is a pawl slot 23 provided in the housing 11, shown best in FIG. 8. The pawl member 13, as best shown in the cutaway views in FIGS. 14 and 15, slides in the pawl slot 23 when the pawl member 13 is retracted from engagement with a keeper member and when the pawl 13 is returned to its extended position (FIG. 14) through the bias of the spring 14. The pawl slot 23 includes guide means for guiding the pawl member 13. Preferably, the guide means is shown comprising elongated slots 25, 26 provided on opposite lateral sides of the pawl slot 23.

Figure 9:
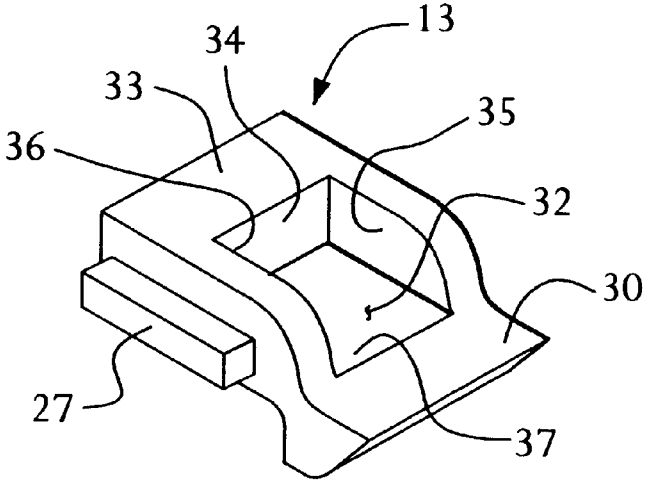
FIG. 9 is a left side, parallel perspective view of the pawl member of the latch shown in FIGS. 1–6.
Figure 10:
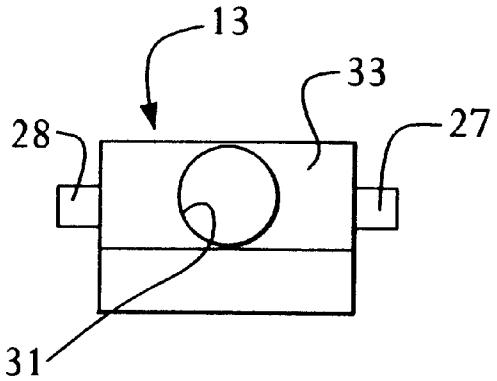
FIG. 10 is a rear elevation view of the pawl member shown in FIG. 9.

Referring to FIGS. 9 and 10, the pawl member 13 is provided with aligning means shown comprising the rail members 27, 28 which are received, respectively, in the guide slots 25, 26 of the housing 11. The pawl member 13 further includes an engaging foot 30 for engaging a keeper member. A retaining bore 31 is disposed in the rear of the pawl member 13 for receipt of an end of the spring 14 therein to retain the spring 14 when the latch 10 is assembled and operated so that there is a biasing of the pawl 13 toward its extended (latching) position. The pawl member 13 further includes an engaging slot 32 disposed in the top portion of the pawl body 33. The engaging slot 32 has a rear wall 34 a right sidewall 35, a left sidewall 36 and a floor 37. The rear wall 34 is provided to be engaged by the tab 16 of the handle 12 when the handle 12 is moved from its latched or horizontal position (FIGS. 1 and 14) to its lifted, unlatching position (FIG. 15).

The housing 11 further includes mounting means for mounting the housing 11 on a panel (not shown). Preferably, the mounting means can comprise retaining members provided on the housing 11 which permit the housing 11 to be installed in a panel cut-out or opening. The mounting means is shown comprising retaining elements 40, 41 extending outwardly from the housing body 22 and spaced apart from the housing flange 21. The mounting means further comprises a holding element 42 provided on the rear of the housing 11, as best shown in FIGS. 5 and 6. The holding element 42 is preferably flexible and has a notched upper edge 43 to facilitate receipt of a panel (not shown) between the upper edge 43 of the element 42 and the underside of the housing mounting flange 21. The housing 11 is preferably installed by inserting the leading edge with the retaining elements 40, 41 into the cut-out, and then lowering the rear of the housing 11 so that the holding element 42 snaps over the panel to retain the assembly in place. The mounting means alternately, or additionally, can comprise mounting elements which extend downwardly from the mounting flange 21 or housing body 22. Screws, rivets, barbs and other suitable mounting elements can also be employed to attach the housing to a closure panel.

Figure 7:
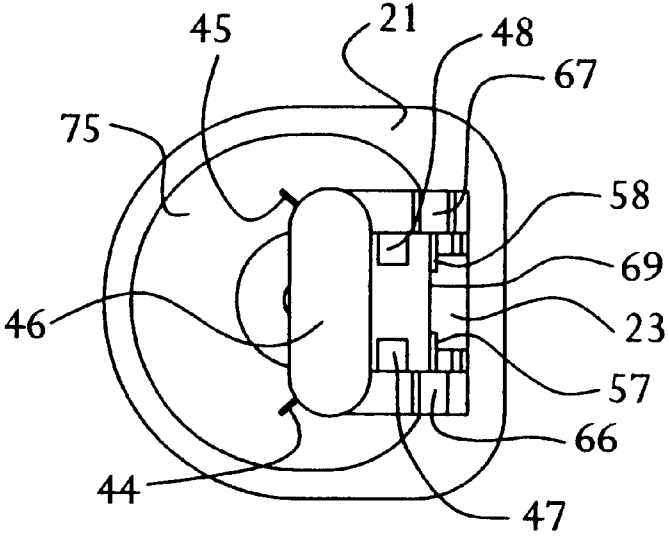
FIG. 7 is a top plan view of the housing of the latch shown in FIGS. 1–6.

Referring to FIGS. 7 and 8, the housing 11 further includes handle-supporting means for supporting the handle 12 thereon. The handle supporting means is shown comprising support elements 44, 45 extending from the housing hub member 46 and being positioned to support the handle 12 thereon. Further handle supporting means can comprise the indented portions 47, 48 which facilitate seating of the handle 12 thereon.

The handle 12 actuates the latch 10 by engaging the pawl 13. The handle 12 is retained on the housing 11 by a pivotal connection thereto. As shown in FIG. 12, the handle 12 contains pivot members 50, 51 extending outwardly therefrom. The pivot members 50, 51 are received in respective pivot recesses 52, 53 provided in the housing (FIG. 8) to permit the handle 12 to be held by the housing 11 and lifted to operate the latch 10. Preferably, the pivot members 50, 51 are tapered to facilitate snap-fit installation into the housing 11. Stop means is provided for stopping the lifting movement of the handle 12 when the latch is operated. The stop means is shown comprising stop members 55, 56 on the front of the handle 12, as shown best in FIG. 13, which engage with the housing stops 57, 58 to limit the lifting of the handle 12 to a maximum position. Alternately, the stop means can be employed by having the handle body 17 engage the housing 11. Furthermore, the handle tab 16 can be configured to be stopped with the element 69 provided on the housing 11.

Supporting elements 62, 63 are preferably provided on the underside of the handle 12, as shown in FIGS. 11–13. The supporting elements 62, 63 are shown having an arcuate shape for enabling the handle 12 to pivot when it is lifted, while providing support for the front of the handle 12 when the latch is closed. The housing 11 is provided with seats 66, 67 (FIGS. 7 and 8) on which the supporting elements 62, 63 of the handle 12, respectively, are supported when the latch 10 is closed. Preferably, the supporting elements 62, 63 are radially configured members which extend from the handle body 17.

Figure 17:
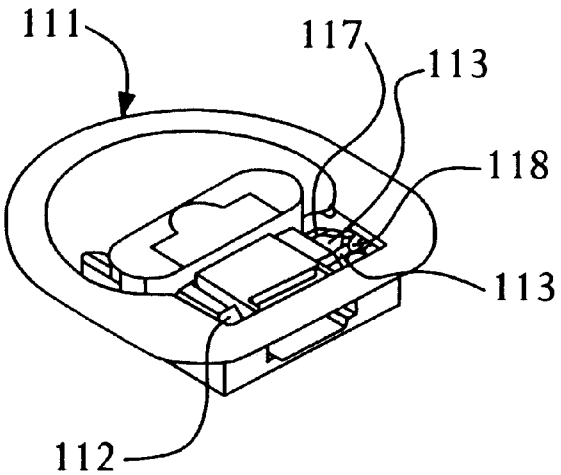
FIG. 17 is left side, parallel perspective view of the alternate housing embodiment of FIG. 16, viewed from the top.
Figure 16:
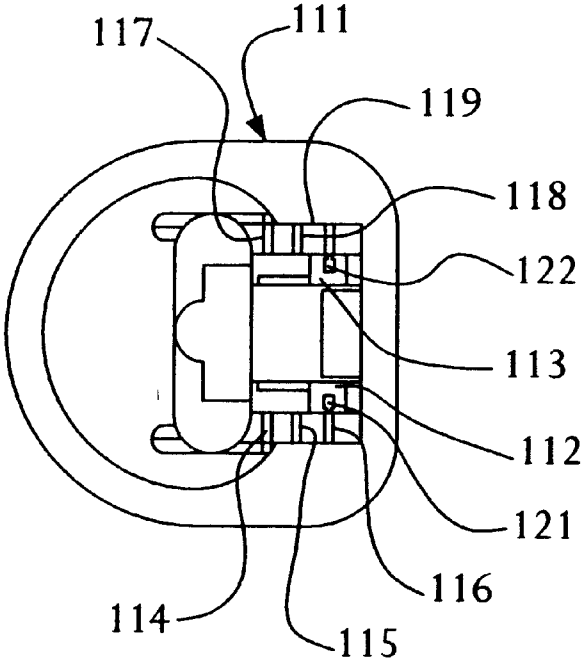
FIG. 16 is a top plan view of an alternate embodiment of a housing according to the present invention.

Referring to FIGS. 16 and 17, an alternate housing 111 is shown. This housing 111 can operate similar to the housing 11 described above. The alternate housing 111 provides bearing seats 112, 113 which support the handle supporting elements 62, 63. A plurality of strengthening ribs 114, 115, 116, 117, 118 and 119 are provided on the housing 111. Handle stop means is also preferably provided on the housing 111. The handle stop means is shown comprising stop elements 121, 122 which are provided to be engaged by the respective stop members 55, 56 of the handle 12. The stop elements 121, 122 limit the lifting of the handle 12, and stop the swing of the handle 12 when a maximum position has been reached.

Grip facilitating means can also be provided on the handle 12, shown best in FIG. 13, comprising an extended or thicker portion 70.

The latch 10 preferably comprises barrier means for guarding against inadvertent access to the compartment being covered by the closure panel (not shown) to which the latch 10 is mounted. The barrier means preferably comprises a lower surrounding flange portion 75 which is provided as a portion of the housing 11 in the area below the handle 12. The surrounding flange 75 is spaced from the handle gripping portion 17 to provide adequate access for gripping the handle 12, while providing a barrier to items, debris, and the like from passing through the latch assembly 10 to the closure compartment (not shown). The surrounding flange 75 further prevents inadvertent entry of a user's fingers or hand into the closure compartment when the latch 10 is actuated.

While not shown, it is also conceivable that a lock can be utilized with the present latch. For example, a lock cylinder may be integrated with the housing 11 to prevent the handle or pawl movement to take place when locked. This could be achieved, for example, with a lockplug. For example, the lockplug can be installed in the handle 12 or housing 11 to selectively secure the handle 12 to the housing 11 to prevent relative movement thereof and thereby prevent the latch 10 from being opened.

Other modifications to the above description can be made consistent with the spirit and scope of the invention disclosed as disclosed in the Summary of the Invention, the Brief Description of the Drawing Figures, and the Detailed Description of the Preferred Embodiments. While the above description constitutes the preferred embodiment of the present invention, it will be appreciated that the invention is subject to modification, variation and change, without departing from the proper scope or fair meaning of the present invention. In this regard, while the various features of the present invention have been shown and described in relation to a floor panel, such as for example that of a vehicle, it will be understood that many of these features are suitable in connection with latching of other members.

What is claimed is:

1. A slam-actuated pawl latch assembly for securing a closure panel, wherein a pawl engages a keeper member, the latch assembly comprising:

a) a housing having a pawl slot therein;

b) a handle pivotally connected to said housing;

c) a pawl member disposed in said pawl slot; and d) biasing means for biasing the pawl member to protrude outwardly from said pawl slot;

e) wherein said handle includes means for engaging said pawl member and retracting said pawl member inwardly toward the housing when the handle is pivoted;

f) wherein said handle comprises a body portion with a lifting portion connected thereto to facilitate lifting of said handle by a user, and wherein said means for engaging said pawl member comprises a tab portion extending downwardly from said handle body portion;

g) wherein said pawl member includes a receiving slot therein for receiving the handle tab portion therein, said receiving slot being defined in part by a wall portion, wherein said tab portion engages said wall portion to draw said pawl member inwardly toward the housing;

h) wherein said pawl slot of said housing includes secondary slot means for guiding said pawl member movement within said housing, and wherein said pawl member includes rail members each disposed laterally on opposite sides of said pawl member receiving slot for travel through said housing secondary slot means when said latch is latched and unlatched;

i) wherein said handle tab portion is disposed for engagement with the pawl member in an area between said rail members; and j) wherein said housing further comprises mounting means for attachment of said latch to said closure panel; wherein said housing has a front wall and wherein said pawl slot is disposed in said housing front wall, wherein said pawl member extends outwardly through said pawl slot, and wherein said mounting means includes mounting elements disposed on said front wall.

2. The latch assembly of claim 1, wherein the latch is provided for installation in an opening provided in the closure panel, the opening being defined by an edge thereabout, wherein said housing further comprises a mounting flange and wherein said mounting means includes mounting elements extending from said housing disposed below said mounting flange for attachment of said latch assembly to said closure panel.

3. The latch assembly of claim 2, wherein said mounting elements comprise a pair of outwardly protruding members disposed on said housing on opposite sides of said pawl slot and a spring element provided on the rear of said housing, said spring element having a first end attached to said housing and a second end having a notch for engagement with the edge of the closure panel opening.

4. The latch assembly of claim 3, wherein said pawl member further includes an engaging foot for engagement with a keeper member.

5. A slam-actuated pawl latch assembly for securing a closure panel, wherein a pawl engages a keeper member, the latch assembly comprising:

a) a housing having a pawl slot therein;

b) a handle pivotally connected to said housing;

c) a pawl member disposed in said pawl slot;

d) biasing means for biasing the pawl member to protrude outwardly from said pawl slot;

e) wherein said handle includes means for engaging said pawl member and retracting said pawl member inwardly toward the housing when the handle is pivoted;

f) wherein said housing further comprises mounting means for mounting said latch to said closure panel;

g) wherein the latch is provided for installation in an opening provided in the closure panel the opening being defined by an edge thereabout, wherein said housing further comprises a mounting flange, and wherein said mounting means includes mounting elements extending from said housing and being disposed below said mounting flange for attaching said latch to a closure panel; and h) wherein said mounting elements comprise a pair of outwardly protruding members disposed on said housing on opposite sides of said housing slot and a spring element provided on the rear of said housing, said spring element having a first end attached to said housing and a second end having a notch for engagement with the edge of the closure panel opening.

6. The latch assembly of claim 5, wherein said pawl member further includes an engaging foot for engagement with a keeper member.

7. A slam-actuated pawl latch assembly for securing a closure panel, wherein a pawl engages a keeper member, the latch assembly comprising:

a) a housing having a slot therein with a central opening and having a channel on each side of said central opening, said channels each communicating with said central opening;

b) a handle having a gripping portion, pivot ends for pivotally connecting said handle to said housing, and a tab portion extending downwardly from said handle;

c) a pawl member having a slot therein said slot being defined in part by at least a rear wall portion, said pawl member further including a rail disposed on each lateral side thereof and extending outwardly therefrom, and a spring-receiving bore disposed in the rear of said pawl member; and d) a spring for biasing the pawl member to protrude from the housing slot;

e) wherein said handle tab portion protrudes into said pawl member slot and engages said rear wall portion of said slot when the handle is lifted;

f) wherein the said housing further comprises mounting means for mounting said latch to said closure panel;

g) wherein the latch is provided for installation in an opening provided in the closure panel the opening being defined by an edge thereabout, wherein said housing further comprises a mounting flange and wherein said mounting means includes mounting elements extending from said housing disposed below said mounting flange, wherein said mounting elements retain said latch assembly on said closure panel;

h) wherein said mounting elements comprise a pair of outwardly protruding members disposed on said housing on opposite sides of said housing slot and a spring element provided on the rear of said housing, said spring element having a first end attached to said housing and a second end having a notch for engagement with the edge of the closure panel opening.

8. The latch assembly of claim 7, wherein said pawl member further includes an engaging foot for engagement with a keeper member.

9. A slam-actuated pawl latch assembly for securing a closure panel, wherein a pawl engages with a keeper provided on an adjacent surface, the latch assembly comprising:

a) a housing having a slot therein with a central opening and having a channel on each side of said central opening, said channels each communicating with said central opening;

b) a handle having a gripping portion, a body, pivot ends for pivotally connecting said handle to said housing, and a tab portion extending downwardly from said handle;

c) a pawl member having a slot therein said slot being defined in part by at least a rear wall portion, said pawl member further including a rail disposed on each lateral side thereof and extending outwardly therefrom, and a spring-receiving bore disposed in the rear of said pawl member;

d) a spring for biasing the pawl member to protrude from the housing slot;

e) wherein said handle tab portion protrudes into said pawl member slot and engages said rear wall portion of said slot when the handle is lifted;

f) wherein said handle is pivotally connected to said housing to pivot along a pivot axis and wherein said tab portion is disposed at a location on said handle body radially offset from said pivot axis;

g) wherein said housing further comprises mounting means for mounting said latch to said closure panel;

h) wherein the latch is provided for installation in an opening provided in the closure panel the opening being defined by an edge thereabout, wherein said housing further comprises a mounting flange and wherein said mounting means includes mounting elements extending from said housing disposed below said mounting flange, wherein said mounting elements are adapted to retain said latch assembly on said closure panel; and i) wherein said mounting elements comprise a pair of outwardly protruding members disposed on said housing on opposite sides of said housing slot and a spring element provided on the rear of said housing, said spring element provided on the rear of said housing, said spring element having a first end attached to said housing and a second end having a notch for engagement with the edge of the closure panel opening.

10. The latch assembly of claim 9, wherein said pawl member further includes an engaging foot for engagement with a keeper member.

* * * * *